United States Patent [19]

Lamb

[11] 3,994,097

[45] Nov. 30, 1976

[54] ABRASIVE OR SAND BLAST APPARATUS AND METHOD

[76] Inventor: Ralph W. Lamb, 1011 SE. 102nd Ave., Vancouver, Wash. 98664

[22] Filed: Apr. 7, 1975

[21] Appl. No.: 565,814

[52] U.S. Cl. ..... 51/11; 51/8 HD; 51/12; 51/321

[51] Int. Cl.[2] ..... B24C 5/04; B24C 7/00; B24C 1/00

[58] Field of Search ..... 51/8 R, 8 HD, 11, 321, 51/319; 239/336

[56] References Cited

UNITED STATES PATENTS

| | | | |
|---|---|---|---|
| 2,040,715 | 5/1936 | Smith | 51/11 |
| 2,107,084 | 2/1938 | Pletcher | 51/11 |
| 2,369,576 | 2/1945 | Keefer | 51/11 |
| 2,526,403 | 10/1950 | Paasche | 51/8 HD |
| 2,751,716 | 6/1956 | Pletcher | 51/11 |
| 3,690,067 | 9/1972 | Goss | 51/11 |

*Primary Examiner*—Al Lawrence Smith
*Assistant Examiner*—Nicholas P. Godici
*Attorney, Agent, or Firm*—Klarquist, Sparkman, Campbell, Leigh, Hall & Whinston

[57] ABSTRACT

Sand blast apparatus is disclosed, which includes a housing with a water inlet nozzle positioned in its rear wall for producing a gradually diverging water jet in the housing, a sand inlet conduit extending obliquely downwardly into said housing, and a discharge nozzle having tapered and cylindrical water discharge passage sections in axial alignment with the water jet and extending from the front wall of the housing. Water under pressure is delivered to the inlet nozzle through a conduit extending back from the housing and having a downwardly extending pistol grip handle and water control valve at its rear end. The apparatus is provided with an upwardly extending handle for use with the pistol grip handle in holding the apparatus in a correct operating position. A vacuum is produced in the housing by venturi action, extending through a sand supply conduit which includes two air inlets, one at a sand supply and another near the water control valve, for drawing two separate air streams into the conduit to fluidize the sand and provide accurate regulation of the sand flow rate.

13 Claims, 3 Drawing Figures

ABRASIVE OR SAND BLAST APPARATUS AND METHOD

BACKGROUND OF THE INVENTION

This invention relates to system for sand blasting using water as a propellant for sand. In one aspect, the invention relates to sand blast apparatus. In another aspect, the invention relates to a method for combining sand and water to form a surface abrading jet.

Pressurized water has been used previously as a propellant in said blasting. Water type sand blasting generally allows more rapid and efficient surface abrasion, or cleaning, than air type sand blasting.

Water type sand blasting systems generally include a pressurized water source, a sand supply container usually called a sand pot, a nozzle assembly for combining and spraying the sand and water, and supply conduits to convey sand and water from their sources to the nozzle assembly. Pressurized water sand blast systems have used a vacuum provided by venturi action in the nozzle assembly to draw air into the sand supply conduit adjacent the sand storage pot to fluidize and convey sand from the sand pot into the nozzle assembly for mixture with the water. These prior systems have several difficulties such as (1) plugging of the sand supply conduit adjacent the nozzle and (2) lack of flexibility in adjustment of the sand flow rate.

When sand in the supply conduit is wet the conduit may become plugged. This sometimes occurs when a sufficiently high vacuum is not produced becasue of insufficient venturi action in the nozle assembly. When this assembly lacks sufficient vacuum to draw in enough air to fluidize the sand, the sand simply remains static in the sand supply conduit. Any water present at the time in the nozzle assembly can backflow into said supply conduit, wetting the sand adjacent the nozzle and causing plugging.

Prior sand blast devices have generally introduced sand into the housing of the nozzle through a sand inlet which enters the housing at a position normally below the point where water is introduced into the housing. When such devices are shut off or water flow is very slow, water in the housing may flow into the sand conduit by the force of gravity, thereby wetting the sand and causing plugging.

Because of inefficiencies in the vacuum producing arrangements utilized, some previous sand blast systems have resorted to the use of extremely high pressure water, as high as 10,000 psi and above, to obtain sufficient vacuum to draw the desired amount of sand from the sand storage pot through the sand supply conduit into the nozzle assembly. Extremely high pressure water is costly to use, and such prior devices have often proved inefficient in their cleaning or abrading action. There is thus a need for a water type sand blast system which (a) provides the necessary operating vacuum in the venturi section of a sand blast nozzle, (b) does so using as low pressure water as possible, and (c) achieves a high surface abrading and cleaning rate compared to conventional sand blast systems.

In previous sand blast systems it has been difficult to provide a sand flow rate through the sand supply conduit accurately controllable at a level desired for a particular use. Previous systems have not consistently provided either a relatively uniform and constant sand flow rate or the desired absolute sand flow rate for a particular applicationn of a system.

The sand blast apparatus and method of the present invention overcome these and other problems found in previous water type sand blast systems.

SUMMARY OF THE INVENTION

The abrasive apparatus of this invention comprises a nozzle assembly formed from a housing which has a water inlet nozzle positioned in a rear wall thereof having an orifice designed to produce a gradually diverging water jet in the housing when pressurized water is delivered to it. A discharge nozzle, having an inner tapered section and an outer cylindrical section, extends from the front wall of the housing positioned coaxially with the water jet with the water inlet nozzle being positioned so that the water jet engages the discharge nozzle at the junction of the tapered and cylindrical sections thereof to provide both a strong, vacuum-producing venturi action in the housing and a high energy abrasive discharge jet from the discharge nozzle. The assembly further includes an abrasive inlet for directing abrasive into the water jet, which then carries it out from the discharge nozzle in the discharge jet.

The present hydraulic abrasive apparatus further includes a rigid water conduit connected to the housing by a flexible section and connected through a control valve to a source of pressurized water, and a rigid abrasive conduit having an upwardly and downwardly curved section adjacent the nozzle housing to prevent water backflow and plugging. The supply conduits are each provided with a handle positioned so as to insure that the gun is held in the correct operating position and providing a rigid, lightweight structure.

The sand supply conduit of the present apparatus has two air inlet openings, one an orifice opening adjacent the sand container and the other an adjustable valve opening adjacent the water control valve for accurately controlling the sand flow rate.

It is therefore an object of the present invention to provide a surface abrasion system wherein a high surface abrasion and cleaning rate is obtained.

It is another object of the present invention to provide a water-using and sand blast system in which plugging of the sand supply conduit in the system is eliminated.

It is a further object of the present invention to provide sand blast apparatus which prevents entry of water into the sand supply conduit.

It is a further object of this invention to provide sand blast apparatus which prevents sand from build up within the sand supply conduit directly adjacent the nozzle housing when the system is shut down or the water flow rate is low.

It is a further object of this invention to provide a sand blast method and said blast apparatus wherein water is employed at a relatively lower pressure in the sand blast nozzle to provide a higher vacuum in the sand blast nozzle assembly and a more efficient output jet than in known systems.

It is a further object of the present invention to provide a sand blast system wherein the flow rate of sand into a nozzle assembly from a sand supply container can be closely metered and maintained at a desired level.

DESCRIPTION OF THE PREFERRED EMBODIMENT

Figure 1:
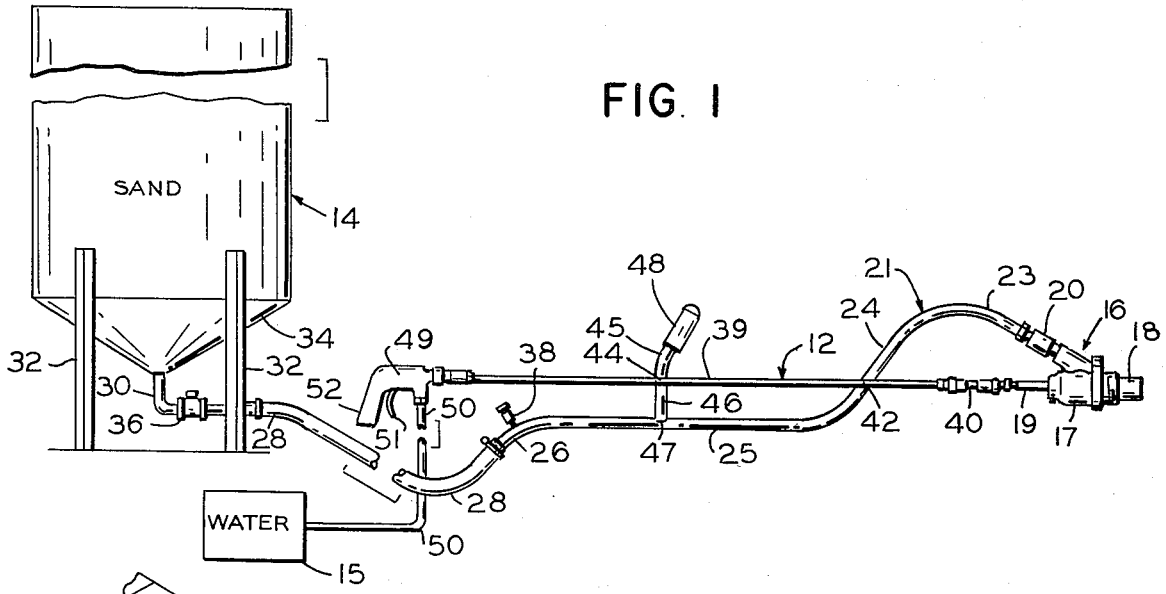
FIG. 1 is a schematic view of an embodiment of the sand blast apparatus of the present invention showing a sand blast gun in side elevation.

Referring to FIG. 1, the preferred embodiment of the abrasive discharge apparatus includes a sand blast gun 12, a sand storage pot 14 and a water source 15 for supplying water under pressure. At the front of the gun 12 is a nozzle assembly 16 (see FIG. 2) into which sand from the pot 14 is carried in a stream of air, where it is mixed with a stream of water from the water source. The nozzle assembly includes a cylindrical nozzle housing 17, a discharge nozzle 18 extending from the front end of the housing for discharging a high velocity jet of a water-sand mixture, a water inlet 19 extending from the rear end of the housing, and a sand inlet 20 extending obliquely upwardly and rearwardly from the top of the housing.

A rigid sand supply conduit 21 is connected to the sand inlet 20 and extends to the rear of the sand blast gun 12. A curved front section 23 of the supply conduit 21 adjacent the sand inlet 20 extends obliquely upwardly and rearwardly from the top of the housing 17. The sand supply conduit then continues in a downwardly curved section 24, followed by a straight, horizontal section 25 extending rearwardly of the gun 12 and the terminating in a short, downwardly and rearwardly extending end section 26. The curved section of the rigid sand supply conduit extends upwardly and then downwardly from the housing 17 when the gun 12 is held in normal operating position. A flexible sand supply conduit, such as a rubber hose 28, has one end connected to the end section 26 of the rigid sand supply conduit and the other end connected to a rigid sand conduit elbow 30.

The elbow 30 extends downwardly and laterally from the bottom of the sand storage pot 14, in which dry sand is stored. The sand pot is supported on legs 32 and has an inwardly, downwardly sloping floor 34, which facilitates gravity flow of sand downward from the sand pot 14 into the elbow 30.

As described below, a vacuum is produced in the interior of the nozzle housing 17 when the gun 12 is in operation. This vacuum extends through the sand inlet 20 and conduits 21 and 28 to the conduit elbow 30. An orifice fitting 36 is positioned intermediate the ends of the laterally extending portion of the sand conduit elbow for receiving any desired one of a plurality of orifice elements (not shown), having air inlet orifices of different sizes for connecting the interior of the elbow 30 with the external atmosphere. Air entering the elbow through an air inlet orifice in the fitting 36 entrains sand which enters elbow 30 by gravity flow, and carries it through the conduits 28, 21 and sand inlet 20 into the housing 17.

An adjustable, fine control air inlet valve 28 is positioned on the sand conduit section 26 for admitting air into the conduit 21. It will be apparent that the rate of flow of sand through the sand conduits into and through the nozzle assembly 16 will vary with the amount of air admitted into the sand supply conduit through the air inlet orifice in the fitting 36 and the air inlet valve 38, the selectable orifices providing rough control and the valve 38 providing fine control.

A rigid water supply conduit 39 is detachably connected to the water inlet 19 by a flexible pressure hose connection 40. The conduit 39 is longitudinally aligned with the nozzle 18 and extends horizontally and rearwardly from the water inlet 19 a short distance past the terminal section 26 of the rigid sand supply conduit 21. The conduit 39 is positioned above and approximately parallel to the straight section 25 of the sand supply conduit and is held in this position by being secured to the rigid sand supply conduit 21 at 42, and also by being secured at 44 to an upwardly extending gripping means comprising a handle 45 which has a shaft section 46 with its lower end secured at 47 to the mid-portion of the straight section 25 of the sand supply conduit. The handle 45 extends above the conduit 39, and terminates in a hand hold section 48. The handle 45 extends upwardly when held in normal operating position by a person using the apparatus. Brazing or welding can be employed at 42, 44 and 47 to secure the water supply conduit 39, the handle 45 and the sand supply conduit together. The water supply conduit 39 is connected at its rear end to a gun type, water flow regulating valve 49, which is also connected by a flexible, high pressure hose 50 to the water source 15. The valve 49 may be operated to permit water to flow from the water supply 15 into the conduit 20 by manually pulling its trigger 51 toward its handle 52, which is of the pistol grip type. The pistol grip handle 52 extends downwardly when held in normal operating position by a person using the apparatus. The air inlet valve 38 and the water valve 49 are positioned near each other for easy fine-tuning adjustment of flow rates during operation of the gun.

The structure of the gun 12 just described provides a rigid, lightweight gun which can conveniently be held in the correct, upright operating position by a person using the apparatus with one hand gripping the pistol grip handle 52 attached to the water control valve 49 and the other hand gripping the upwardly extending hand hold section 48 of the handle 45. It will be apparent from the positions of the handles 45 and 52, that the only positions in which the sand blast gun can be conveniently held by a person using it are those in which the sand inlet 20 is positioned above the remainder of the nozzle assembly 16, on the upper side of the housing 17 when its axis is horizontal, insuring that the sand entering the assembly remains dry until it is within the housing 17. When the water supply is shut off, any sand adjacent the housing 17 in the sand inlet 20 and the conduit 21 falls into the housing 17. Any sand in the housing is discharged by water flowing through the housing during the next start up, rather than becoming wet while in the sand inlet and conduit. This avoids plugging the sand inlet 20 and conduit 21 with wet sand.

Figure 2:
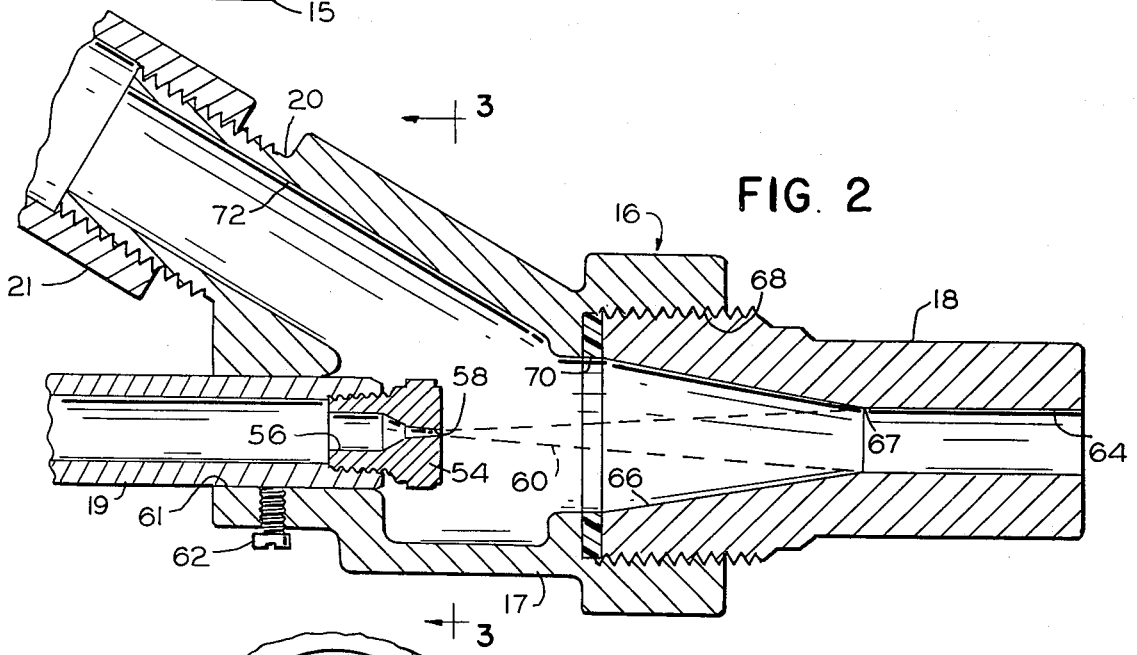
FIG. 2 is a vertical, longitudinal, sectional view of a sand blast nozzle assembly forming part of the sand blast gun of FIG. 1.
Figure 3:
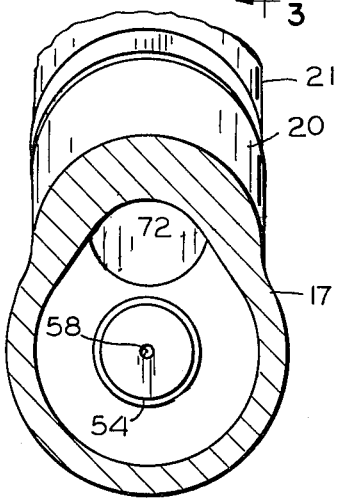
FIG. 3 is a sectional view of the nozzle assembly taken along lines 3—3 of FIG. 2.

Referring to FIG. 2, the water inlet 19 of the nozzle assembly 16 has a water nozzle 54 screw-threaded into its inner end. The nozzle 54 has a water passage 56 extending through it, positioned concentrically with the water inlet 19. The water passage 56 has a cylindrical inlet portion and a rapidly converging intermediate portion. It terminates in a gradually converging orifice 58 at its inner end, so as to produce a gradually diverging, conical water jet 60, indicated by dotted lines, in the interior of the housing 17. The orifice 58 is suitably tapered to provide an angle of divergence of between about 5° to 25°, and preferably between about 5° to 15°, in the jet 60, the water jet shown in the drawing having a divergence of approximately 9° . The jt 60 need not be circular in cross section although such configuration is preferred. The water inlet 19 is slidably inserted into the housing 17 through a water inlet aperture 61 in the rear wall of the housing. It can be adjusted longitudinally, so as to position the impact area of the jet 60 as desired and is held in the desired adjusted position by a set screw 62.

The discharge nozzle 18 includes a generally cylindrical discharge passageway section 64 within its outer portion and a tapered or frustoconical passageway section 66 within its inner portion, both sections being in axial alignment with the orifice 58 in the water nozzle 54. The passageway section 64 is of greater diameter than the orifice 58 and has its inner end joined to the tapered passageway section 66 at a junction 67, the tapered passageway section diverging toward the orifice 58. The interior surfaces of both passageway sections are preferably lined with a suitable abrasion resistant material. The discharge nozzle 18 is spaced axially from the water nozzle 54 to provide an unobstructed passageway for sand from the sand inlet conduit 20 into the water jet 60. The nozzle 18 is secured in a discharge aperture 68 in the front wall of the housing 17 by mating threaded sections on the outer rear portion of the nozzle 18 and the surface of the aperture 68. A flexible washer such as polyurethane washer 70 is preferably inserted between the rear end of the discharge nozzle 18 and the housing 17 to provide a seal betwen them.

The sand inlet 20 has a cylindrical sand passageway 72 which extends longitudinally upwardly and rearwardly from the space between the water nozzle 54 and the discharge nozzle 18 in the housing 17, at an oblique angle of about 30 degrees to the axis of the discharge nozzle 18, as shown in FIG. 2.

The water jet 60 is shown in FIG. 2 as being positioned so as to have its outer peripheral portion engage the inner surface of the discharge passageway in the discharge nozzle substantially at the junction 67 between the sections 64 and 66 of this passage. A relatively stronger vacuum may be achieved within the housing 17 by positioning the water nozzle with its orifice 58 somewhat further back from the discharge nozzle 18 than shown, so that the outer peripheral portion of the water jet 60 engages the tapered passageway section 66 closer to its inner end, rather than at the junction 67 at its outer end. However, a stronger, higher energy, abrasive discharge jet can be discharged from the nozzle 18 if the orifice 58 is positioned so that the outer peripheral portion of the water jet 60 engages the nozzle 18 substantially at the junction 67. In this position a very satisfactory vacuum may be obtained throughout a substantial range of water inlet pressure. For example, a vacuum of about 22 inches of mercury may be obtained when using a water pressure of abouut 2000 pounds per square inch and a flow rate of about 9 gallons per minute through a nozzle having a minimum diameter of 0.094 inch. This vacuum is used to draw a stream of air through the air inlet orifice in the fitting 36, which fluidizes and carries sand from the pot 14 through the conduits 28 and 21 and the sand inlet 20 into contact with the water jet 60. The sand and air are drawn into admixture with water in the rapidly moving jet 60, which imparts a very high velocity to the particles of sand. The resulting mixture of sand and water, along with some air, is discharged at high velocity from the nozzle 18 to provide a high energy, surface abrading medium.

The discharge diameter of the orifice 58 can be selected by changing nozzles 54 to provide a selected throughput of water for a desired water pressure. Similarly, the size of the exit passageway 64 in the nozzle 18 can be changed. As a specific example, the discharge diameter of the orifice 58 may be approximately 0.094 inch and that of the discharge passageway 64 approximately 0.375 inch, with an inlet water pressure of 1800–2000 psi, to produce a water throughput of approximately 9 gallons per minute. This arrangement is capable of drawing up to about 700 pounds of 30 grit Monterey sand per hour from the tank 14. Alternatively, using a diameter of 0.072 inch for orifice 58 with a 0.375 inch discharge passageway 64, and a water pressure of about 1000 psi, provides a water throughput of about 4 gallons per minute. This arrangement is capable of drawing up to about 400 pounds of sand per hour from the tank 14.

In operation, the gun 12 is pointed toward the surface to be abraded by an operator who grasps the upwardly extending handle 45 with one hand and the downwardly facing pistol grip handle 52 with the other. When the valve trigger 51 is pulled toward the pistol grip handle 52, water flows from the high pressure water source 15 through the conduits 50 and 39 and the water inlet 19, and out of the orifice 58. Sand is drawn from the pot 14 and is ejected at high velocity from the nozzle 18 with the water. The nozzle 18 is held between about 18 to 24 inches from the surface to be abraded, the operator swinging the sand and water jet across such surface. Paint, rust and other foreign material can be rapidly removed from metal surfaces, concrete or the like. Instead of sand, other materials such as crushed walnut shells can be used as the abrasive.

A preferred embodiment of the method and apparatus of the invention having been described, the broad scope of the invention and alternatives, variations and modifications of the preferred embodiment within the scope of the invention will be apparent to those skilled in the art.

I claim:

1. Abrasive discharge appparatus comprising;

a generally cylindrical housing means;

water inlet means in one end of said housing means including an orifice for producing an inlet water jet in said housing means directed toward the opposite end of said housing means and diverging at an angle of about 5° or greater when said water inlet means is connected to a source of water under pressure;

discharge nozzle means in said opposite end of said housing means having a discharge passage in axial alignment with the axis of said orifice;

said discharge passage including an outer discharge portion of greater diameter than said orifice terminating externally of said housing and including a tapered inner portion having a junction with said outer portion and gradually diverging from said junction toward said orifice;

said water inlet means being spaced axially from said discharge nozzle means so that the outer peripheral portion of said diverging water jet engages the inner surface of said discharge passage substantially at said junction;

and abrasive inlet means in the side wall of said housing for delivering a stream of abrasive admixed with air into said housing;

said abrasive mixing with said water jet in said housing means and being propelled by said jet through said discharge passage.

2. Apparatus as defined in claim 1 wherein said orifice is adapted to provide a gradually diverging inlet water jet of conical shape.

3. Apparatus as defined in claim 2 wherein said water inlet means is spaced axially from said discharge nozzle means so that said outer peripheral portion of said gradually diverging water jet engages said inner surface of said discharge passage substantially at said junction.

4. Apparatus as defined in claim 1 further including a water supply conduit having a straight, rigid section axially aligned with said axis of said water inlet orifice and secured at one end thereof to said water inlet means for introducing water into said water inlet means.

5. Apparatus as defined in claim 4 further including abrasive container means and adbrasive conduit means communicating at one end thereof with said abrasive inlet means and at the other end thereof with said abrasive container means.

6. Apparatus as defined in claim 5 further including a first air inlet opening in said abrasive conduit adjacent said abrasive container means and a second air inlet opening in said abrasive conduit spaced from said abrasive container means, whereby said abrasive conduit and the external atmosphere are in communication.

7. Apparatus as defined in claim 6 further including adjustable valve means operatively connected into said second air inlet opening for regulating the flow of air therethrough.

8. Apparatus as set forth in claim 1 wherein said angle is between 5° and 25° .

9. Apparatus as set forth in claim 1 wherein said angle is between 5° and 15° .

10. Abrasive discharge apparatus comprising;

a generally cylindrical housing means;

water inlet means in one end of said housing means including an orifice for producing a gradually diverging inlet water jet in said housing means directed toward the opposite end of said housing means when said water inlet means is connected to a source of water under pressure;

discharge nozzle means in said opposite end of said housing means having a discharge passage in axial alignment with the axis of said orifice;

said discharge passage including an outer discharge portion of greater diameter than said orifice terminating externally of said housing and including a tapered inner portion having a junction with said outer portion and gradually diverging from said junction toward said orifice;

said water inlet means being spaced axially from said discharge nozzle means so that the outer peripheral portion of said diverging water jet engages the inner surface of said discharge passage;

abrasive inlet means in the side wall of said housing for delivering a stream of abrasive admixed with air into said housing;

said abrasive mixing with sand water jet in said housing means and being propelled by said jet through said discharge passage;

abrasive container means and abrasive conduit means communicating at one end thereof with said abrasive inlet means and at the other end thereof with said abrasive container means;

said abrasive conduit means including a rigid, curved section connected at one end thereof to said housing means, extending generally outwardly from said housing means and then generally inwardly, and terminating adjacent said rigid water conduit section at the other end thereof;

and a rigid, straight section attached at one end thereof to said other end of said curved section and extending generally parallel to said rigid water conduit section.

11. Apparatus as defined in claim 10 further including a pistol grip handle fixed to said rigid water conduit section at the end thereof opposite said one end thereof, said handle extending in a first direction substantially normally to the longitudinally axis of said water conduit section, and a second handle attached to said second abrasive conduit section between the opposite ends thereof and extending in a second direction opposite said first direction substantially normally to the longitudinal axis of said second abrasive conduit section;

the longitudinal centerline of said first abrasive conduit section, said pistol grip handle, and said second handle being substantially in the same plane, whereby said apparatus is held in normal operating position with said pistol grip handle extending generally downwardly, said second handle extending generally upwardly, and said rigid curved abrasive section extending generally upwardly and then generally downwardly from said housing means.

12. Sand blast apparatus comprising in combination:

a generally cylindrical nozzle housing having a water inlet in the rear end thereof, a sand inlet in the top end thereof and a discharge outlet in the front end thereof;

a discharge nozzle in said outlet defining a discharge passageway including a frustoconical inner section and a cylindrical outer section, said inner section being connected to said housing at the larger end thereof and having a junction with said cylindrical section at the smaller end thereof, said inner and outer sections having the same longitudinal axis;

a water inlet nozzle connected between said water inlet and said housing including an orifice having the axis thereof aligned with the longitudinal axis of said discharge passageway;

a water conduit communicating between said water inlet and a pressurized water source including a shorter flexible section connected at the front end thereof to said water inlet and a longer, rigid, straight section connected at the front end thereof to the rear end of said flexible section, and having its longitudinal axis aligned with said discharge passageway;

a pistol grip handle fixed to the rear end of said rigid water conduit section and extending in a first outward direction substantially normally to the longitudinal axis of said rigid water conduit section;

a water flow regulating valve operatively connected to said rigid water conduit sectin;

a sand container;

a sand conduit communicating between said sand inlet and said sand container having a first air inlet therein adjacent said container and including a curved, rigid section connected to said housing at the front end thereof and extending outwardly and then inwardly and rearwardly from said housing and a straight rigid section connected at the front end thereof to the rear end of said curved section, extending generally rearwardly parallel to said rigid water conduit section, and having a second air inlet therein;

an adjustable air valve operatively connected into said second air inlet;

a second handle including a shaft section having one end fixed to said straight sand conduit section intermediate the ends thereof extending in a second outward direction substantially normally to the longitudinal axis of said straight sand conduit section and opposite to said first direction and including a hand hold section at the outer end thereof;

said pistol grip handle, said second handle and said curved sand conduit section having their longitudinal centerlines substantially in a plane, whereby said pistol grip handle extends downwardly, said second handle extends upwardly and said curved sand conduit section extends upwardly and then downwardly from said housing when said apparatus is held in normal operating position.

13. The method of sand blasting which comprises:

introducing water through an orifice into a nozzle housing to produce a gradually diverging conical water jet in said housing;

directing said water jet into a discharge passage in axial alignment with said water jet in an opposite end of said housing, said passage having an outer discharge portion of greater diameter than said orifice and terminating externally of said housing and an inner frustoconical tapered portion having a junction with said discharge portion and gradually diverging toward said jet, to produce a discharge jet from said discharge portion and a vacuum in said housing;

positioning said water jet axially with respect to said discharge passage so that the outer surface of said water jet engages the inner surface of said discharge passage substantially at said junction.

* * * * *

UNITED STATES PATENT OFFICE
CERTIFICATE OF CORRECTION

PATENT NO. : 3,994,097
DATED : November 30, 1976
INVENTOR(S) : RALPH W. LAMB

It is certified that error appears in the above-identified patent and that said Letters Patent are hereby corrected as shown below:

Column 1, line 12: "said" should be --sand--

Column 1, line 32: "nozle" should be --nozzle--

Column 2, line 42: delete "and" between "water-using" and "sand"

Column 2, line 54: "said" should read -- sand --.

Column 3, line 31: delete "the" between "and" and "terminating"

Column 3, line 60: "28" should be --38--

Column 5, line 1: "jt" should be --jet--

Column 7, line 62, Claim 10: "sand" should be --said--

Column 8, line 60, Claim 12: "sectin" should be --section--

Signed and Sealed this
Twenty-second Day of February 1977

[SEAL]

*Attest:*

RUTH C. MASON
*Attesting Officer*

C. MARSHALL DANN
*Commissioner of Patents and Trademarks*